US006972638B2

(12) United States Patent
Usami et al.

(10) Patent No.: US 6,972,638 B2
(45) Date of Patent: Dec. 6, 2005

(54) DIRECTIONAL COUPLER AND ELECTRONIC DEVICE USING THE SAME

(75) Inventors: Kunihiro Usami, Yamanashi (JP); Toshiaki Moriuchi, Yamanashi (JP)

(73) Assignee: Fujitsu Quantum Devices Limited, Yamanashi (JP)

( * ) Notice: Subject to any disclaimer, the term of this patent is extended or adjusted under 35 U.S.C. 154(b) by 83 days.

(21) Appl. No.: 10/463,447

(22) Filed: Jun. 18, 2003

(65) Prior Publication Data

US 2004/0000965 A1 Jan. 1, 2004

(30) Foreign Application Priority Data

Jun. 28, 2002 (JP) ..... 2002-191462

(51) Int. Cl.[7] ..... H01P 5/12; H01P 5/18
(52) U.S. Cl. ..... 333/109; 333/116
(58) Field of Search ..... 333/109, 116, 204, 333/238

(56) References Cited

U.S. PATENT DOCUMENTS 4,809,356 A * 2/1989 Peckham et al. ..... 455/86
5,212,815 A * 5/1993 Schumacher ..... 455/126
5,907,266 A * 5/1999 Budka et al. ..... 333/116
6,496,708 B1 * 12/2002 Chan et al. ..... 455/553.1

FOREIGN PATENT DOCUMENTS

| | | |
|---|---|---|
| EP | 0859464 A3 | 8/1998 |
| JP | 1-262479 | 10/1989 |
| JP | 2-280065 | 11/1990 |
| JP | 5-37213 | 2/1993 |
| JP | 8-505750 | 6/1996 |
| JP | 10-190321 | 7/1998 |
| JP | 10-290108 | 10/1998 |
| JP | 10-303761 | 11/1998 |
| JP | 11-308024 | 11/1999 |
| JP | 2000-165117 | 6/2000 |
| WO | 95/13631 | 5/1995 |

* cited by examiner

*Primary Examiner*—Daniel D. Chang
(74) *Attorney, Agent, or Firm*—Westerman, Hattori, Daniels & Adrian, LLP

(57) ABSTRACT

A directional coupler includes a transmission line, and a coupling line, the transmission line being coupled with the coupling line. The transmission line is located at a height position different from that of the coupling line with respect to a reference plane. The transmission line and the coupling line have portions that do not overlap each other.

22 Claims, 7 Drawing Sheets

B)

DIRECTIONAL COUPLER AND ELECTRONIC DEVICE USING THE SAME

BACKGROUND OF THE INVENTION

1. Field of the Invention

The present invention generally relates to directional couplers, and more particularly, to a directional coupler used in a high-frequency circuit that handles high-frequency signals over hundreds of MHz.

2. Description of the Related Art

Conventionally, a directional coupler using a microstrip line is known. This kind of directional coupler has two parallel transmission lines that are formed on a substrate backed with a ground electrode. When a high-frequency signal passes through one of the two transmission lines in parallel, a signal develops on the other transmission line due to electromagnetic coupling. For example, the directional coupler is installed in the transmission system of a radio apparatus, and extracts some transmission power, which is used to control a power amplifier based on the transmission power.

A cellular phone capable of transmitting and receiving signals in two different frequency bands has been practically used. The directional coupler is used to monitor the transmission frequencies in the bands and control transmission power. The directional coupler used for the above purpose is a dual coupler. The dual coupler has three parallel transmission lines formed on the substrate. Transmission power is applied to the two transmission lines on both sides, and monitor powers that develop on the central transmission line due to electromagnetic coupling are monitored.

FIGS. 1A and 1B and FIG. 2 show a conventional dual coupler. More particularly, FIG. 1 is a perspective view of the conventional dual coupler, and FIG. 1B is a cross-sectional view taken along a line $I_B$—$I_B$. FIG. 2 is a plan view of the dual coupler shown in FIGS. 1A and 1B. The dual coupler has a semiconductor substrate 12 backed with a ground electrode 11, on which substrate transmission lines 13 and 14 and a coupling line 15 are formed. The semiconductor substrate 12 is made of, for example, GaAs. The transmission line 13 and the coupling line 15 are arranged in parallel with a gap G1. Similarly, the transmission line 14 and the coupling line 15 are arranged in parallel with a gap G2. The transmission lines 13 and 14 and the coupling line 15 may be made of, for example, gold. For example, a transmission signal (in the 900 MHz band) in GSM (Global System for Mobile Communications) is applied to an input port 16 of the transmission line 13, the transmission signal being applied to the next stage via an output port 17. A signal develops on the coupling line 15 due to planar electromagnetic coupling caused by the transmission signal traveling along the transmission line 13. One end of the coupling line 15 is grounded via a terminating resistor 20, and the signal generated due to electromagnetic coupling may be extracted via the other end. Another transmission signal (in the 1.8 GHz band) in DCS (Digital Cellular System) is applied to an input port 18 of the transmission line 14, the transmission signal being applied to the next stage via an output port 19. A signal develops on the coupling line 15 due to planar electromagnetic coupling caused by the transmission signal traveling along the transmission line 14. In this manner, both the GSM transmission signal and the DCS transmission signal can be monitored via the coupling line 15.

The degree of coupling between the adjacent transmission line and the coupling line mainly depends on frequency. The higher the frequency, the higher the degree of coupling.

Thus, in the above-mentioned example, the DCS signal is more strongly coupled with the coupling line 15 than the GSM system signal. It is preferable that the levels (or powers) of the signals monitored via the coupling line 15 are equal to each other. It is thus required to relatively adjust the degree of coupling between the transmission line 13 and the coupling line 15 and the degree of coupling between the transmission line 14 and the coupling line 15. This adjustment may be carried out by varying the gaps between the transmission lines and the coupling lines and/or varying the lengths of the transmission lines. More particularly, the gap G1 between the transmission line 13 and the coupling line 15 is set narrower than the gap G2 between the transmission line 14 and the coupling line 15. For instance, the gap G1 is equal to 10 $\mu$m, and the gap G2 is equal to 20 $\mu$m. In this case, W1=W2=60 $\mu$m, and W3=10 $\mu$m, for example. Further, as shown in FIG. 2, the section in which the transmission line 13 and the coupling line 15 are adjacent to each other and are thus electromagnetically coupled is set longer than the section in which the transmission line 14 and the coupling line 15 are adjacent to each other and are thus electromagnetically coupled. For example, the section in which the transmission line 13 and the coupling line 15 are coupled is equal to 4.62 mm, and the section in which the transmission line 14 and the coupling line 15 are coupled is equal to 4.02 mm. The substrate 12 has an area of 3.0 $mm^2$ (equal to 1.65 mm×1.80 mm).

In FIG. 2, the terminating resistor 20 shown in FIG. 1A may be realized by a diffused resistor or a thin-film resistor. The resistor 20 is connected to one end of the coupling line 15 via a pad 25. The other end of the terminating resistor 20 is connected, via a via 24, to the ground electrode 11 on the backside of the substrate 12. The other end of the coupling line 15 is connected to a pad 23. A detector (not shown) may be connected to the pad 23. Reference numerals 26–29 are auxiliary circuits, which may be used to test the performance of the dual coupler. In the auxiliary circuits, mesh patterns denote resistors, and comparatively large dual squares denote vias, and comparatively small squares denote pads.

However, the conventional directional coupler mentioned above has a large size and difficulty in downsizing. For example, if it is attempted to narrow the gaps G1 and G2 for the purpose of downsizing, an excessively high degree of coupling will develop, and the transmission lines and the coupling line may be short-circuited. Therefore, there is a certain limit on narrowing the gaps G1 and G2. In this case, in order to obtain desired coupling power, it is necessary to lengthen the transmission lines and the coupling line. However, this needs a larger substrate.

SUMMARY OF THE INVENTION

It is therefore an object of the present invention to provide a compact directional coupler and an electronic device equipped with such a coupler.

The above object of the present invention is achieved by a directional coupler comprising: a transmission line; and a coupling line, the transmission line being coupled with the coupling line, the transmission line being located at a height position different from that of the coupling line with respect to a reference plane, the transmission line and the coupling line having portions that do not overlap each other.

The above object of the present invention is also achieved by an electronic device comprising: a directional coupler and a detector, the directional coupler comprising: a transmission line; and a coupling line, the transmission line being coupled with the coupling line, the transmission line being located at a height position different from that of the coupling line with respect to a reference plane, the transmission line and the coupling line having portions that do not overlap each other, the detector being connected to the coupling line.

The above object of the present invention is also achieved by an electronic device comprising: a directional coupler and an amplifier, the directional coupler comprising: a transmission line; and a coupling line, the transmission line being coupled with the coupling line, the transmission line being located at a height position different from that of the coupling line with respect to a reference plane, the transmission line and the coupling line having portions that do not overlap each other, the amplifier being connected to the transmission line.

The above object of the present invention is also achieved by an electronic device comprising: a directional coupler and a filter, the directional coupler comprising: a transmission line; and a coupling line, the transmission line being coupled with the coupling line, the transmission line being located at a height position different from that of the coupling line with respect to a reference plane, the transmission line and the coupling line having portions that do not overlap each other, the filter being connected to the transmission line.

The above object of the present invention is achieved by an electronic device comprising: a directional coupler, a detector and a filter, the directional coupler comprising: a transmission line; and a coupling line, the transmission line being coupled with the coupling line, the transmission line being located at a height position different from that of the coupling line with respect to a reference plane, the transmission line and the coupling line having portions that do not overlap each other, the detector being connected to the coupling line, the filter being connected to the transmission line.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

A description will now be given of embodiments of the present invention with reference to the accompanying drawings.

(First Embodiment)

Figure 3A:
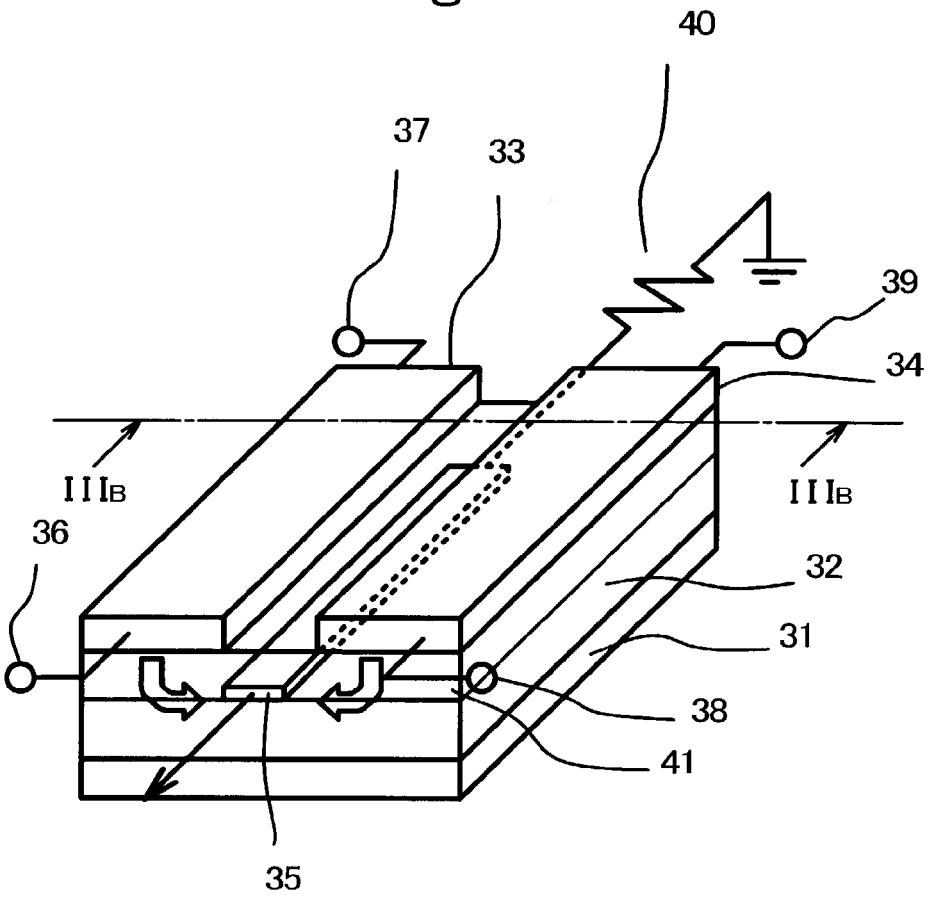
FIG. 3A is a perspective view of a directional coupler according to a first embodiment of the present invention.
Figure 3B:
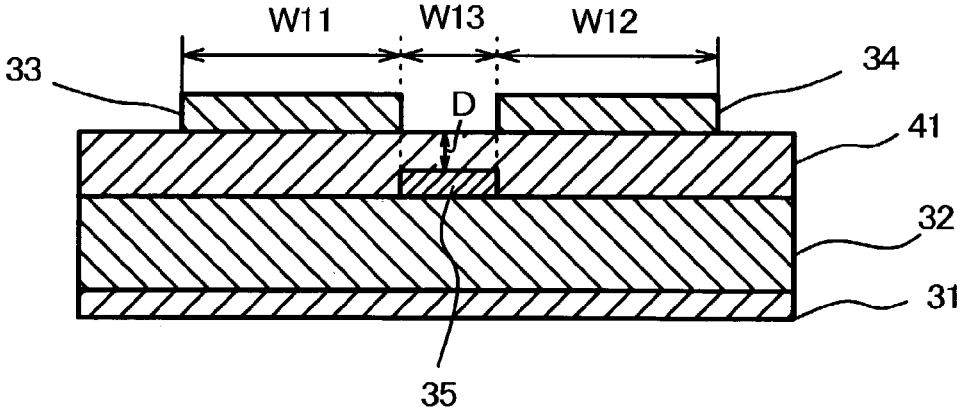
FIG. 3B is a cross-sectional view taken along a line $III_B$—$III_B$ shown in FIG. 3A.
Figure 4:
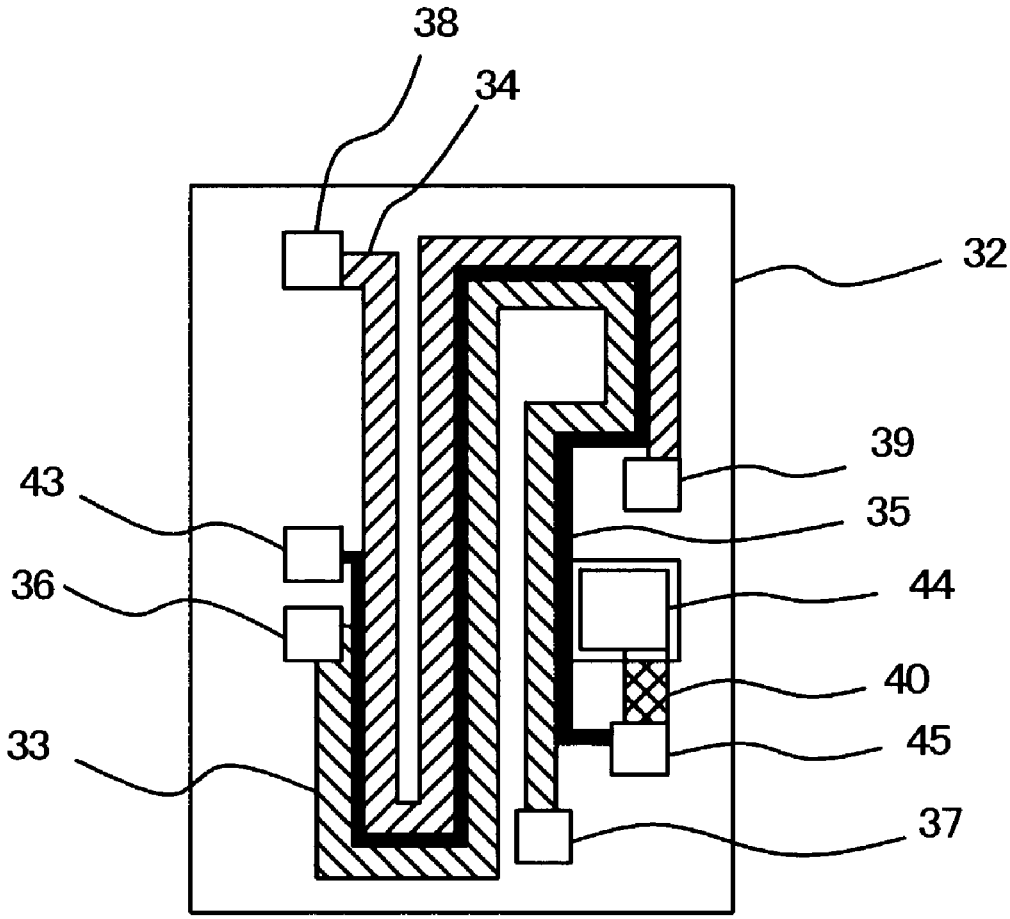
FIG. 4 is a plan view of the directional coupler shown in FIGS. 3A and 3B.

FIG. 3A is a perspective view of a directional coupler according to a first embodiment of the present invention, and FIG. 3B is a cross-sectional view taken along a line $III_B$—$III_B$ shown in FIG. 3A. FIG. 4 is a plan view of the directional coupler shown in FIGS. 3A and 3B. FIGS. 3A and 3B are enlarged views of a part of the directional coupler shown in FIG. 4.

The directional coupler according to the first embodiment of the present invention is a dual coupler, which has multiple transmission lines 33 and 34 (two lines in the present embodiment), and a coupling line 35. The transmission lines 33 and 34 are formed on a plane, and the coupling line 35 is formed on another plane. More particularly, the coupling line 35 is formed on a semiconductor substrate 32, and the transmission lines 33 and 34 are formed on an insulation layer 41, which covers the entire main surface of the semiconductor substrate 32 and the coupling line 35. The transmission lines 33 and 34 run in parallel on the insulation layer 41 with a spacing. The transmission lines 33 and 34 are located at a position that is vertically different from a position at which the coupling line 35 is located. The transmission lines 33 and 34 are not flush with the coupling line 35. The transmission lines 33 and 34 have a height that is different from the height of the coupling line 35 with respect to a reference plane. The reference plane is, for example, the bottom surface of the semiconductor substrate 32 or the surface of the ground electrode 31 formed on the bottom (back) surface of the semiconductor substrate 32. The coupling line 35 is formed directly on the semiconductor substrate 32, while the transmission lines 33 and 34 are located above the semiconductor substrate 32. The transmission lines 33 and 34 and the coupling line 35 are arranged so as to form a multilayer structure (two-layer structure in the present embodiment).

The coupling line 35 is located at a height position lower than that of the transmission lines 33 and 34 with respect to the reference plane. The bottom surfaces of the transmission lines 33 and 34 are spaced apart from the upper surface of the coupling line 35 by distance D in the vertical direction. The transmission lines 33 and 34 do not overlap the coupling line 35 in the vertical direction. As shown in FIG. 3B, the transmission lines 33 and 34 do not overlap the coupling line 35 over the entire lengths thereof. That is, the transmission lines 33 and 34 and the coupling line 35 do not have any overlapping portion. The inner side of the transmission line 33 and the corresponding side of the coupling line 35 are substantially located on the same imaginary plane, as shown in FIG. 3B. In other words, there is no horizontal spacing between the inner side of the transmission line 33 and the corresponding side of the coupling line 35. The transmission line 33 and the coupling 35 are positioned so as to prevent vertical overlapping. Similarly, the inner side of the transmission line 34 and the corresponding side of the coupling line 35 are located on the same imaginary plane. In other words, there is no horizontal spacing between the inner side of the transmission line 34 and the corresponding side of the coupling line 35.

The transmission line 33 is two-dimensionally coupled with the coupling line 35 as indicated by the left arrow in FIG. 3A. Similarly, the transmission line 34 is two-dimensionally coupled with the coupling line 35 as indicated by the right arrow in FIG. 3B. It is thus possible to define the reduced gaps in the horizontal direction between the transmission lines and the coupling line, as compared with the conventional planar coupling. In the embodiment being considered, there is no horizontal gap. The minimum distance (distance in the vertical direction) between the transmission lines 33 and 34 and the coupling line 35 is comparatively short. However, since the electric flux lines are two-dimensionally formed, the lengths of the electric flux lines are the sum of the lengths of the vertical and horizontal paths. Thus, the transmission lines 33 and 34 are physically close to the coupling line 35, nevertheless a desired degree of coupling can be obtained without short-circuiting. The minimum distance corresponds to the aforementioned minimum distance D. The minimum distance D may be, for example, 3 $\mu$m. In this case, the transmission lines 33 and 34 have widths W11 and W12 equal to 60 $\mu$m, and a thickness of 6 $\mu$m. The coupling line 35 has a width W13 of 20 $\mu$m and a thickness of 6 $\mu$m.

In the structure shown in FIGS. 3A and 3B, the distance between the transmission line 33 and the coupling line 35 is equal to that between the transmission line 34 and the coupling line 35. Therefore, in order to obtain, from the coupling line 35, the same monitor levels (powers) of the signals transferred over the transmission lines 33 and 34, it is necessary to adjust the degree of coupling by, for example, the lengths of the coupling sections in which the transmission lines 33 and 34 are adjacent to the coupling line 35. By way of example, a case is considered where the GSM is transferred over the transmission line 33, and the DCS signal is transferred over the transmission line 34. In this case, it is required to set a comparatively large degree of coupling between the transmission line 33 and the coupling line 35. This is achieved by an arrangement shown in FIG. 4. The length of the section in which the transmission line 33 is coupled with the coupling line 35 is longer than that of the section in which the transmission line 34 is coupled with the coupling line 35. One end of the transmission line 33 is connected to a pad 36 serving as an input terminal (input port), and the other end is connected to a pad 37 serving as an output terminal (output port). Similarly, one end of the transmission line 34 is connected to a pad 38 serving as an input terminal, and the other end is connected to a pad 39 serving as an output terminal. One end of the coupling line 35 is connected to a pad 43 serving as a monitor output terminal, and the other end is connected to a pad 45. The pad 45 is connected to one end of a terminating resistor 40, which may be a diffused resistor or thin-film resistor. The terminating resistor 40 has an impedance of, for example, 50 Ω. The other end of the terminating resistor 40 is connected to the ground electrode 31 (FIGS. 3A and 3B) formed on the backside of the semiconductor substrate 32 via a via 44 formed therein. The semiconductor substrate 32 may be made of a semiconductor material such as GaAs. The transmission lines 33 and 34 and the coupling line 35 may be made of, for example, gold. The insulating layer 41 may be made of, for example, polyimide.

The GSM transmission line 33 and the coupling line 35 are adjacent to each other over 3.10 mm. The DCS transmission line 34 and the coupling line 35 are adjacent to each other over 2.53 mm. The semiconductor substrate 32 has a chip size of 0.92 mm×1.44 mm=1.32 mm$^2$. According to the present embodiment, the chip size can be reduced to about 57% of the conventional chip size.

The first embodiment of the present invention is the directional coupler serving as the dual coupler. The aforementioned two-layer structure may be applied to a single coupler equipped with a single transmission line. Even in the single coupler, a desired degree of coupling (monitor power) can be obtained although the line length is reduced as compared to the conventional coupler.

Figure 5:
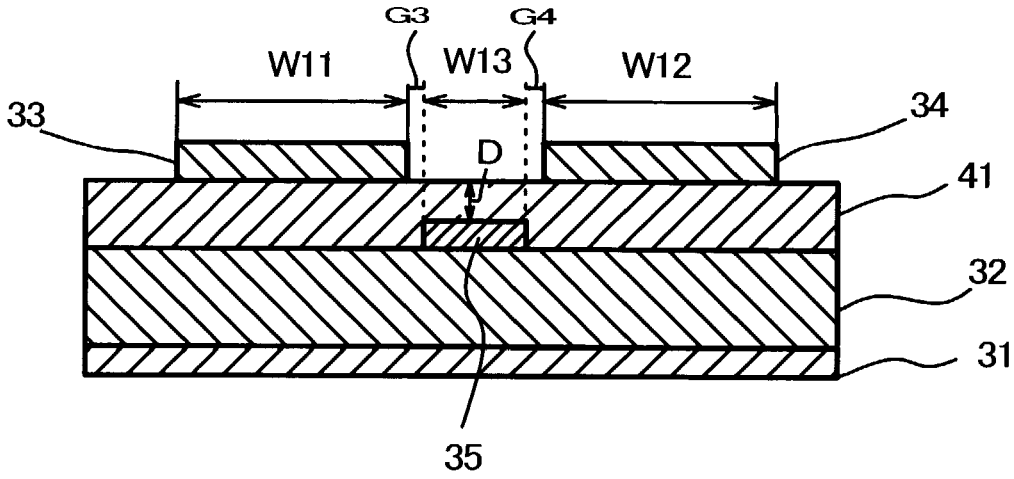
FIG. 5 is a cross-sectional view of a variation of the directional coupler shown in FIGS. 3A and 3B.

FIG. 5 shows a variation of the first embodiment of the present invention. This directional coupler has a slight gap G3 between the transmission line 33 and the coupling line 35 in the horizontal direction, and a slight gap G4 between the transmission line 34 and the coupling line 35 in the horizontal direction. In this case, the directional coupler of the present invention may have the gaps G3 and G4. Either the gap G3 or G4 may be employed. Principally, the transmission line 33 and/or the transmission line 34 may slightly overlap the coupling line 35 in the vertical direction. That is, the transmission lines 33 and 34 and the coupling line 35 have respective overlapping portions. The transmission lines 33 and 34 may have different height positions with reference to the reference plane. This may cause the distance between the transmission line 33 and the coupling line 35 to differ from that between the transmission line 34 and the coupling line 35. It is thus possible to realize the different degrees of coupling.

Figure 1A:
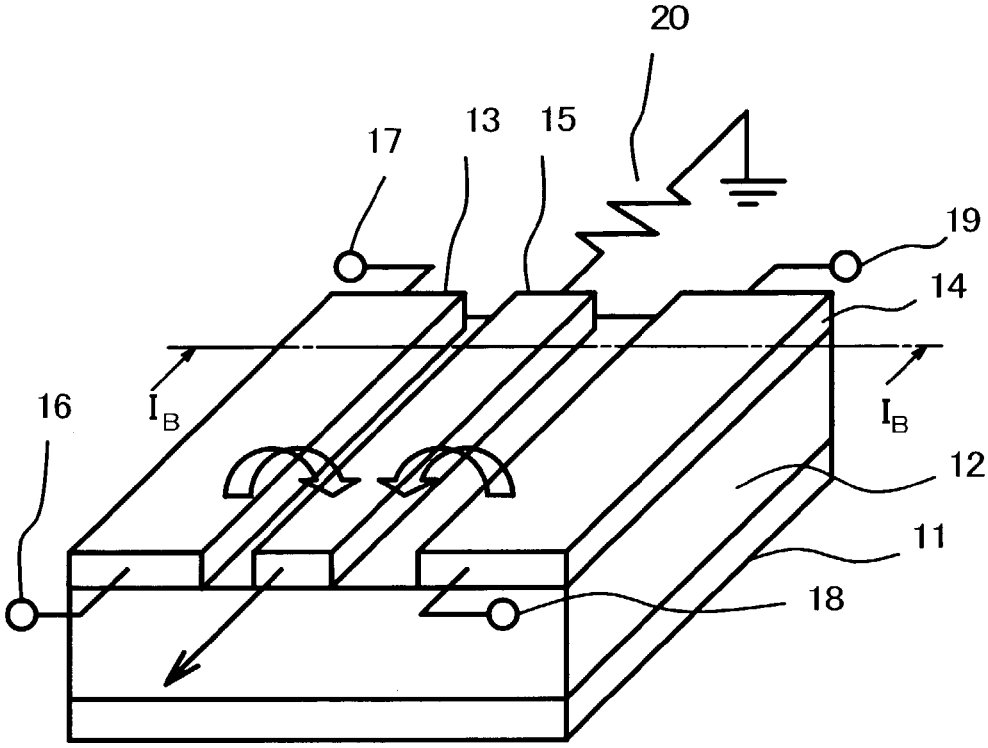
Fig. 1A PRIOR ART
FIG. 1A is a perspective view of a conventional directional coupler.
Figure 1B:
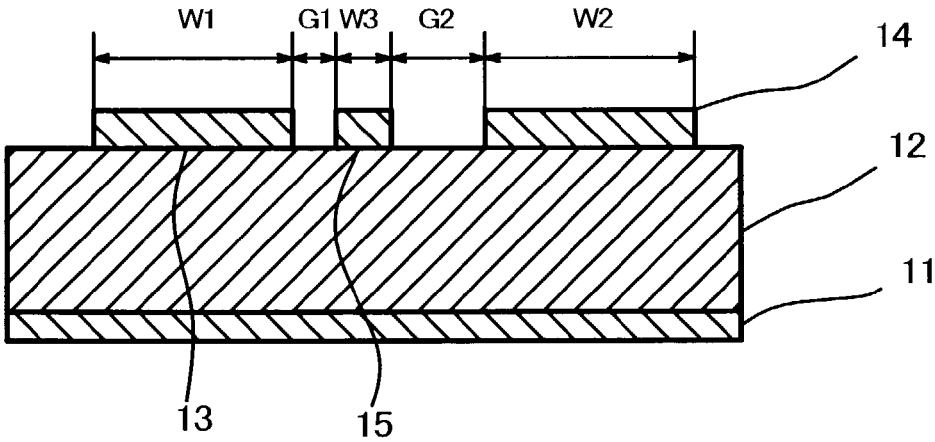
Fig. 1B PRIOR ART
FIG. 1B is a cross-sectional view taken along a line $I_B$—$I_B$ shown in FIG. 1A.
Figure 2:
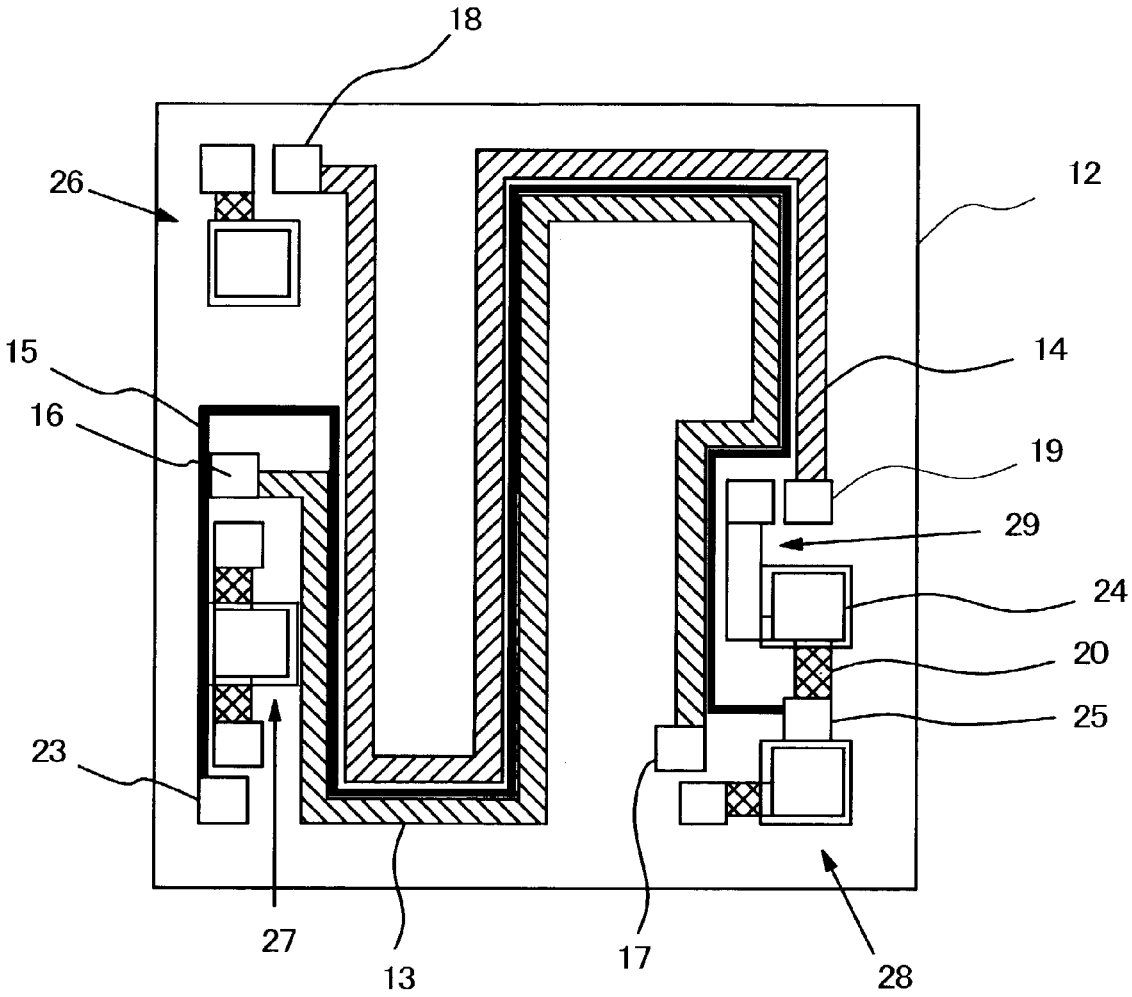
Fig. 2 PRIOR ART
FIG. 2 is a plan view of the directional coupler shown in FIGS. 1A and 1B.
Figure 6A:
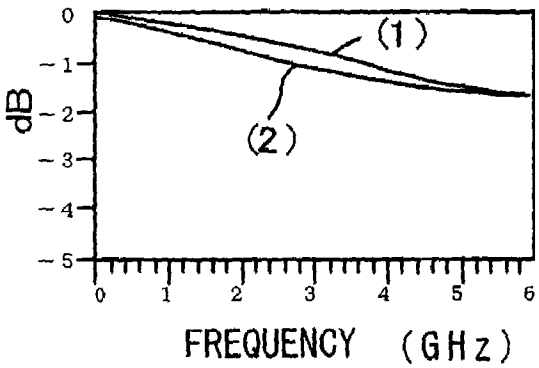
FIGS. 6A through 6F are respectively graphs of frequency characteristics of the conventional directional coupler shown in FIGS. 1A and 1B and the directional coupler shown in FIGS. 3A and 3B.
Figure 6B:
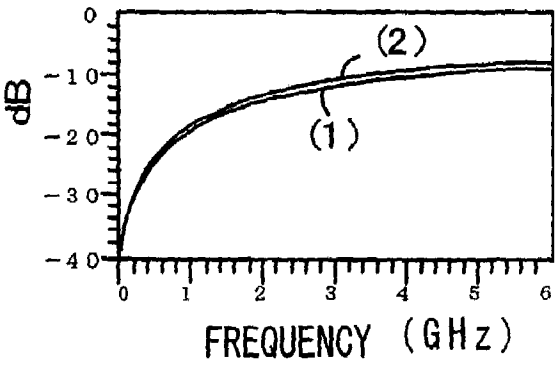
Figure 6C:
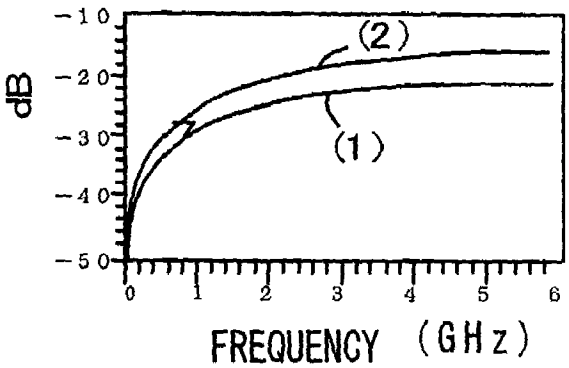
Figure 6D:
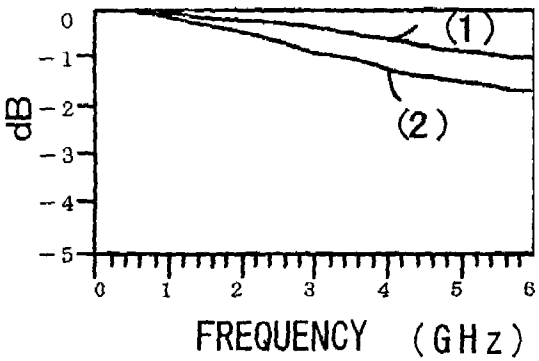
Figure 6E:
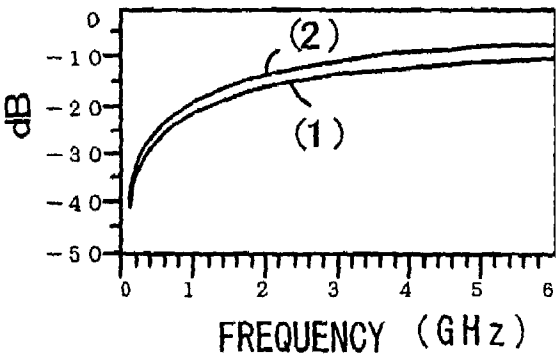
Figure 6F:
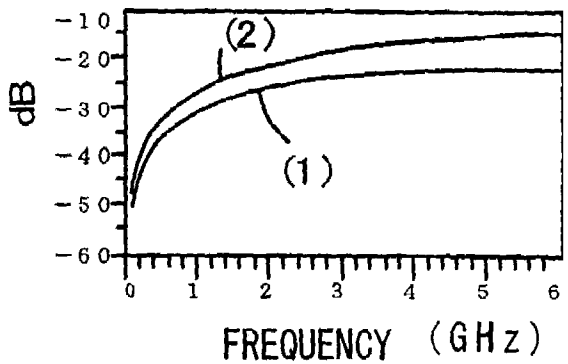

FIGS. 6A through 6F show the frequency characteristics of the conventional dual coupler shown in FIGS. 1A, 1B and 2 and the dual coupler shown in FIGS. 3A, 3B and 4 according to the first embodiment of the present invention. More particularly, FIGS. 6A, 6B and 6C show frequency characteristics in the GSM band, and FIGS. 6D, 6E and 6F show frequency characteristics in the DCS band higher than the GSM band. The vertical axes of FIGS. 6A through 6F denote gain (dB). In FIGS. 6A–6F, (1) indicates the frequency characteristics of the dual coupler according to the first embodiment of the present invention, and (2) indicates those of the conventional dual coupler. FIGS. 6A and 6D show insertion loss, and FIGS. 6B and 6E show the degrees of coupling. FIGS. 6C and 6F show the isolation characteristics. Isolation expresses the magnitude of power that develops on the transmission lines when a high-frequency signal is applied to the coupling line 35. It can be seen from FIGS. 6A through 6F that the dual coupler according to the first embodiment of the present invention is superior to the conventional dual coupler.

(Second Embodiment)

Figure 7:
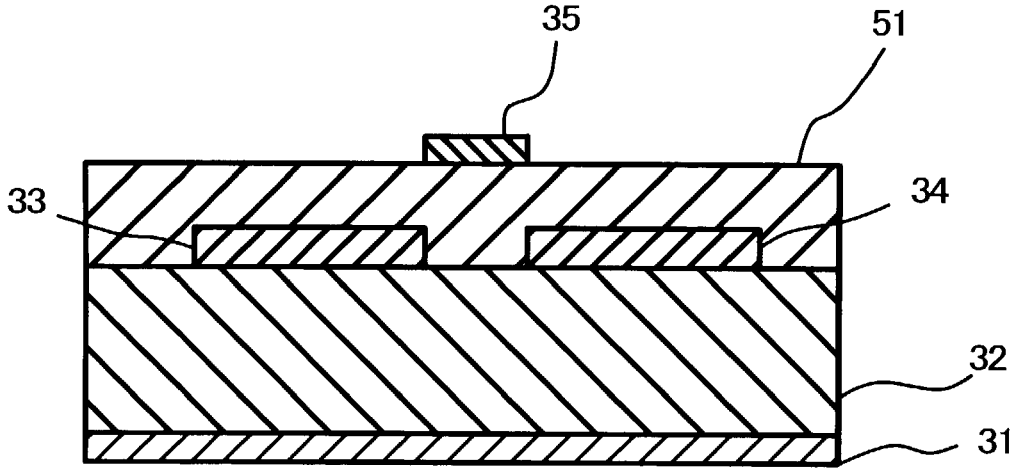
FIG. 7 is a cross-sectional view of a directional coupler according to a second embodiment of the present invention.

FIG. 7 is a cross-sectional view of a dual coupler according to a second embodiment of the present invention. In FIG. 7, parts that are the same as those shown in the previously described figures are given the same reference numerals. Like the dual coupler according to the first embodiment of the present invention, the dual coupler shown in FIG. 7 has a two-layer structure, which includes the transmission lines 33 and 34 and the coupling line 35. However, the dual coupler shown in FIG. 7 has the reverse relationship in position between the transmission lines 33 and 34 and the coupling line 35. More particularly, the transmission lines 33 and 34 are provided on the semiconductor substrate 32 and are adjacent to each other via spacing. An insulating layer 51 is formed so as to cover the entire surface of the semiconductor substrate 32 and the transmission lines 33 and 34. The coupling line 35 is provided on the insulating layer 51. The coupling lines 33 and 34 are located at a position lower than the position at which the coupling line 35 is provided. The same functions and effects as those of the first embodiment of the invention may be brought about by the second embodiment. The dual coupler shown in FIG. 7 may be varied like the variation of the first embodiment of the invention.

(Third Embodiment)

FIGS. 8A through 8D show electronic devices according to a third embodiment of the present invention. These electronic devices are equipped with the directional coupler of the invention and a circuit element coupled herewith. A reference number 60 denotes a dual coupler that is an example of the directional coupler of the invention. The first transmission system (for example, the GSM system) has an input terminal IN1 and an output terminal OUT1, and the second transmission system (for example, the DCS system) has an input terminal IN2 and an output terminal OUT2.

Figure 8A:
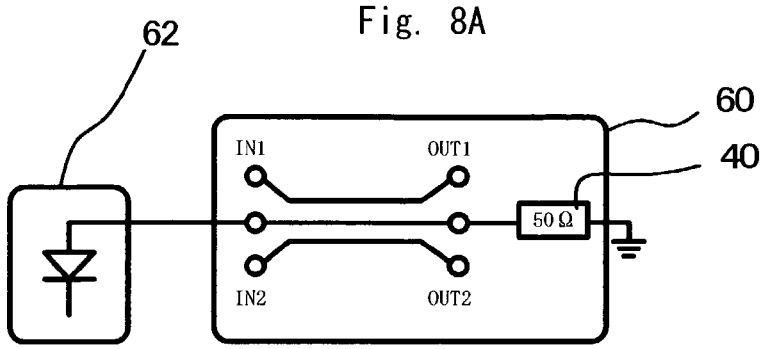
FIGS. 8A through 8D are respectively schematic plan views of electronic devices according to a third embodiment of the present invention.
Figure 8B:
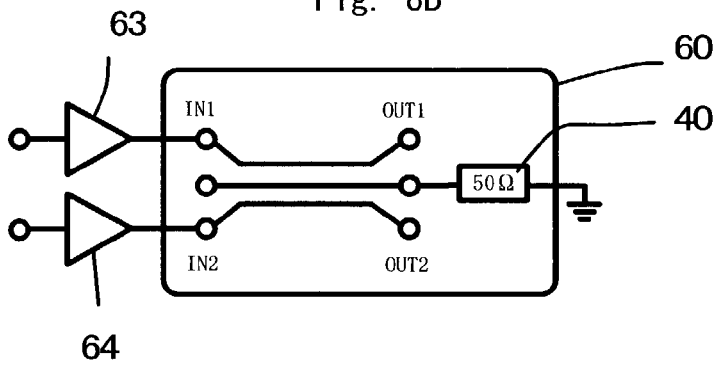
Figure 8C:
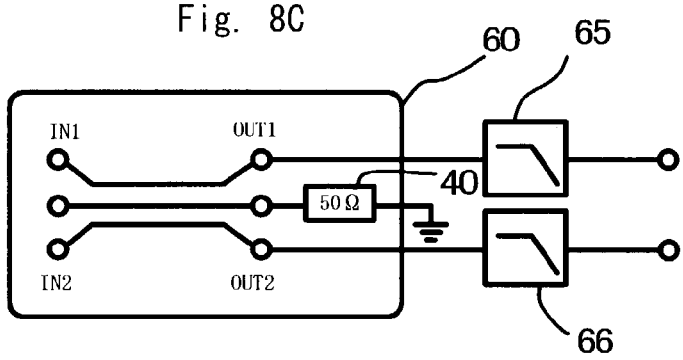
Figure 8D:
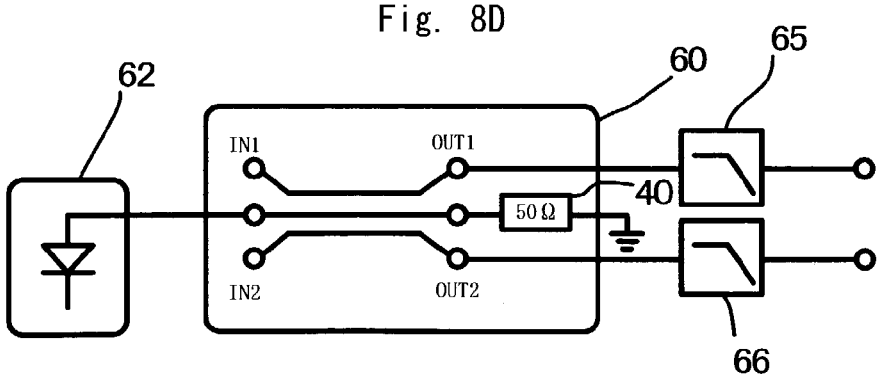

The electronic device shown in FIG. 8A is equipped with the dual coupler 60 and a detector 62, which may be formed on an identical wiring board. The detector 62 monitors the powers of the GMS and DCS transmission signals, and outputs resultant detection signals. The electronic device shown in FIG. 8B is equipped with the dual coupler 60 and two power amplifiers 63 and 64, which may be formed on an identical wiring board. The power amplifiers 63 and 64 may be controlled based on the powers of the first and second transmission systems monitored by a detector (corresponding to the detector 62 shown in FIG. 8A) externally attached to the electronic device. The electronic device shown in FIG. 8C is equipped with the dual coupler 60 and filters 65 and 66 respectively associated with the first and second transmission systems. The filters 65 and 66 may be integrally formed on an identical wiring board together with the dual coupler 60. The filters 65 and 66 may be low-pass filters, which eliminate unwanted high-frequency signal components. The detector 62 shown in FIG. 8A and the amplifiers 63 and 64 shown in FIG. 8B may be externally connected to the electronic device shown in FIG. 8C. The electronic device shown in FIG. 8D corresponds to the combination of the structures shown in FIGS. 8A and 8C. Although not illustrated, the combination of the structures shown in FIGS. 8B and 8D may be made.

The present invention is not limited to the specifically disclosed embodiments, and other embodiments, variations and modifications thereof may be made without departing from the scope of the present invention. For example, the transmission lines 33 and 34 and the coupling line 35 may partially overlap each other in the vertical direction.

The present invention is based on Japanese Patent Application No. 2002-191462 filed on Jun. 28, 2002, and the entire disclosure of which is hereby incorporated by reference.

What is claimed is:

1. A directional coupler comprising:

a transmission line; and a coupling line, the transmission line being coupled with the coupling line, the transmission line being located at a height position different from that of the coupling line with respect to a reference plane, the transmission line and the coupling line having portions that do not overlap each other at all over entire widths thereof.

2. The directional coupler as claimed in claim 1, wherein the transmission line and the coupling line do not overlap with each other over the entire lengths thereof.

3. The directional coupler as claimed in claim 1, wherein the transmission line and the coupling line have portions that overlap each other.

4. The directional coupler as claimed in claim 1, further comprising a semiconductor substrate on which the coupling line is provided, and a ground electrode associated with the transmission line and the coupling line is provided on a backside of the semiconductor substrate.

5. The directional coupler as claimed in claim 1, further comprising a semiconductor substrate for the transmission line and the coupling line, and a resistor formed on the semiconductor substrate, which has a via electrically connected to the resistor.

6. The directional coupler as claimed in claim 1, further comprising:

a semiconductor substrate for the transmission line and the coupling line;

a resistor provided on a first surface of the semiconductor substrate; and a ground electrode provided on a second surface of the semiconductor substrate, the semiconductor substrate having a via that electrically connects the resistor and the ground electrode.

7. The directional coupler as claimed in claim 1, wherein the transmission line and the coupling line are positioned so as to have no overlapping in a vertical direction.

8. The directional coupler as claimed in claim 1, wherein the transmission line includes multiple transmission lines coupled with the coupling line.

9. The directional coupler as claimed in claim 1, wherein:

the transmission line includes multiple transmission lines coupled with the coupling line; and each of the multiple transmission lines is adjacent to the coupling line over a respective different length.

10. The directional coupler as claimed in claim 1, wherein the transmission line includes multiple transmission lines, each of which is supplied with a different radio frequency signal.

11. The directional coupler as claimed in claim 1, further comprising a semiconductor substrate having a surface on which the coupling line is provided, and an insulation layer that covers the surface of the semiconductor substrate, the transmission line being provided on the insulating layer.

12. The directional coupler as claimed in claim 1, further comprising a semiconductor substrate having a surface on which the transmission line is provided, and an insulation layer that covers the surface of the semiconductor substrate, the coupling line being provided on the insulating layer.

13. A directional coupler comprising:

a transmission line; and a coupling line, the transmission line being coupled with the coupling line, the transmission line being located at a height position different from that of the coupling line with respect to a reference plane, the transmission line and the coupling line having portions that do not overlay each other, the directional coupler further comprising a semiconductor substrate having a surface on which the coupling line is provided, and an insulation layer that covers the surface of the semiconductor substrate, the transmission line being provided on the insulating layer.

14. A directional coupler comprising:

a transmission line; and a coupling line, the transmission line being coupled with the coupling line, the transmission line being located at a height position different from that of the coupling line with respect to a reference plane, the transmission line and the coupling line having portions that do not overlay each other, the directional coupler further comprising a semiconductor substrate having a surface on which the transmission line is provided, and an insulation layer that covers the surface of the semiconductor substrate, the coupling line being provided on the insulating layer.

15. An electronic device comprising:

a directional coupler and a detector, the directional coupler comprising:

a transmission line; and a coupling line, the transmission line being coupled with the coupling line, the transmission line being located at a height position different from that of the coupling line with respect to a reference plane, the transmission line and the coupling line having portions that do not overlap each other at all over entire widths thereof, the detector being connected to the coupling line.

16. The electronic device as claimed in claim 15, further comprising a resistor connected to the coupling line.

17. An electronic device comprising:

a directional coupler and an amplifier, the directional coupler comprising:

a transmission line; and a coupling line, the transmission line being coupled with the coupling line, the transmission line being located at a height position different from that of the coupling line with respect to a reference plane, the transmission line and the coupling line having portions that do not overlap each other at all over entire widths thereof, the amplifier being connected to the transmission line.

18. The electronic device as claimed in claim 17, further comprising a resistor connected to the coupling line.

19. An electronic device comprising:

a directional coupler and a filter, the directional coupler comprising:

a transmission line; and a coupling line, the transmission line being coupled with the coupling line, the transmission line being located at a height position different from that of the coupling line with respect to a reference plane, the transmission line and the coupling line having portions that do not overlap each other at all over entire widths thereof, the filter being connected to the transmission line.

20. The electronic device as claimed in claim 19, further comprising a resistor connected to the coupling line.

21. An electronic device comprising:

a directional coupler, a detector and a filter, the directional coupler comprising:

a transmission line; and a coupling line, the transmission line being coupled with the coupling line, the transmission line being located at a height position different from that of the coupling line with respect to a reference plane, the transmission line and the coupling line having portions that do not overlap each other at all over entire widths thereof, the detector being connected to the coupling line, the filter being connected to the transmission line.

22. The electronic device as claimed in claim 21, further comprising a resistor connected to the coupling line.

* * * * *